US009801452B2

(12) United States Patent
Duthoit

(10) Patent No.: US 9,801,452 B2
(45) Date of Patent: Oct. 31, 2017

(54) BACKPACK WITH BALLISTIC INSERT

(71) Applicant: ANDASIMA, Cormeilles-en-Parisis (FR)

(72) Inventor: David Duthoit, Moussy le Vieux (FR)

(73) Assignee: ANDASIMA, Cormeilles-en-Parisis (FR)

( * ) Notice: Subject to any disclaimer, the term of this patent is extended or adjusted under 35 U.S.C. 154(b) by 0 days.

(21) Appl. No.: 15/124,121

(22) PCT Filed: Jan. 26, 2016

(86) PCT No.: PCT/EP2016/051499
§ 371 (c)(1),
(2) Date: Sep. 7, 2016

(87) PCT Pub. No.: WO2016/120231
PCT Pub. Date: Aug. 4, 2016

(65) Prior Publication Data

US 2017/0013948 A1 Jan. 19, 2017

(30) Foreign Application Priority Data

Jan. 30, 2015 (FR) ..... 15 50725
Jan. 30, 2015 (FR) ..... 15 50726
Jan. 30, 2015 (FR) ..... 15 50727

(51) Int. Cl.
*A45F 3/06* (2006.01)
*F41H 1/02* (2006.01)
*F41H 1/00* (2006.01)

(52) U.S. Cl.
CPC ..... *A45F 3/06* (2013.01); *F41H 1/00* (2013.01); *F41H 1/02* (2013.01)

(58) Field of Classification Search
CPC ..... A45F 3/06; A45F 2003/003; F41H 1/00; F41H 1/02

(Continued)

(56) References Cited

U.S. PATENT DOCUMENTS 4,830,245 A * 5/1989 Arakaki ..... A45F 3/04 2/2.5
5,031,733 A * 7/1991 Chang ..... A41D 15/04 190/1

(Continued)

FOREIGN PATENT DOCUMENTS

FR 2962017 A1 1/2012
WO 2012/001112 A1 1/2012
WO 2013/124513 A1 8/2013

OTHER PUBLICATIONS

Apr. 13, 2016 International Search Report issued in International Patent Application No. PCT/EP2016/051499.

*Primary Examiner* — Brian D Nash
(74) *Attorney, Agent, or Firm* — Oliff PLC

(57) ABSTRACT

A backpack contains a compartment having an opening; a flap movable between a closed position closing the opening and first and second open positions leaving the opening open; a ballistic protection shield, passing through the opening and over the head of a backpack wearer, movable from a storage position in the inside of the compartment to a deployed position in which it protects the torso of the backpack wearer; and shield straps linking the shield to the compartment capable of suspending the shield in the deployed position. The backpack defining a passage between the edge of the opening and the flap in the closed position and having a pull-type handle fixed to the shield and projecting to the outside of the compartment by way of this passage when the shield is in the storage position and when the flap is in the closed position.

36 Claims, 1 Drawing Sheet

(58) Field of Classification Search
USPC ..... 224/576, 577, 153
See application file for complete search history.

(56) References Cited

U.S. PATENT DOCUMENTS

| | | | | |
|---|---|---|---|---|
| 5,149,203 | A * | 9/1992 | Sacks | A45C 3/00 190/125 |
| 5,776,838 | A * | 7/1998 | Dellinger | B32B 5/26 442/199 |
| 6,419,132 | B1 * | 7/2002 | Reed | A45C 15/00 109/49.5 |
| 6,685,071 | B2 * | 2/2004 | Prather | A45C 15/00 2/2.5 |
| 6,843,012 | B1 * | 1/2005 | Dodd | G09F 21/02 224/627 |
| 7,971,516 | B2 * | 7/2011 | Hogan | F41H 5/08 109/49.5 |
| 8,453,896 | B1 * | 6/2013 | Mansell | A45C 3/001 206/287 |
| 9,003,947 | B1 * | 4/2015 | Rittenhouse, Jr. | F41H 1/02 2/2.5 |
| 9,044,074 | B1 * | 6/2015 | De Freitas | F41H 1/02 |
| 9,354,023 | B1 * | 5/2016 | Rittenhouse, Jr. | F41H 1/02 |
| 2003/0047579 | A1 * | 3/2003 | Vernon | A45C 3/02 224/617 |
| 2006/0261115 | A1 * | 11/2006 | Gracer | A45F 3/04 224/653 |
| 2009/0014490 | A1 | 1/2009 | Bradley | |
| 2011/0113520 | A1 * | 5/2011 | Dennis | F41H 1/02 2/2.5 |

* cited by examiner

BACKPACK WITH BALLISTIC INSERT

TECHNICAL FIELD

The present invention relates to a backpack with a ballistic insert.

STATE OF THE ART

FR 2 962 017 describes a backpack comprising:

a compartment exhibiting a compartment opening, a flap that can be moved between a closed position in which it closes the compartment opening and first and second open positions in which it leaves the compartment opening open after swinging over from the closed position towards the back and front of the compartment, respectively, a ballistic protection shield or "charge" or "ballistic insert" that can be moved, passing through the compartment opening and over the head of a backpack wearer, from a storage position in which it is accommodated in the inside of the compartment to a deployed position in which it protects the torso of the backpack wearer, straps linking the shield to the compartment or "shield straps" capable of suspending the shield in the deployed position.

According to the invention described in FR 2 962 017, the backpack defines a passage between the edge of the compartment opening and the flap in the closed position and comprises a handle, hereinafter referred to as a "pull-type handle", fixed to the shield, said handle projecting to the outside of the compartment by way of this passage when the shield is in the storage position and when the flap is in the closed position.

A backpack of this kind is referred to as the "backpack described in the preamble" in the description below.

By pulling the pull-type handle, the wearer opens the flap and removes the shield from the compartment. He can then position it against his torso.

This type of backpack is intended to be worn discreetly, particularly by the security forces. It is important that the shield can be deployed rapidly and that, once in the deployed position, said shield provides the wearer with maximum protection.

There is therefore an ongoing need for a backpack of the type described in the preamble which is more discreet and/or can be deployed more quickly and/or offers greater protection.

An aim of the present invention is to respond to this need.

BRIEF DESCRIPTION OF THE INVENTION

In a first main embodiment, the invention proposes a backpack of the type described in the preamble which is noteworthy in that the flap is made at least in part of a ballistic protection material, in other words it is capable of offering the wearer protection against gunfire or other ammunition.

Advantageously, the flap thereby helps to protect the wearer.

In a second main embodiment, the invention proposes a backpack of the type described in the preamble, noteworthy in that the shield straps exhibit a degree of elasticity.

During deployment of the shield, in other words during its movement from the storage position to the deployed position, the wearer may thereby move the shield away from the edge of the compartment opening to create an opening which allows the wearer's head or neck to pass through. The elasticity of the shield straps allows this gap to be increased, which enables the head to pass through and speeds up deployment.

Advantageously, a backpack of this kind may therefore be used by a wearer equipped with a helmet, for example a motorcycle helmet or a combat helmet.

Moreover, after the head has passed through, the wearer relaxes the tension on the straps, which allows the shield to move back up the wearer's torso towards his neck. This means that the upper part of the torso can be perfectly protected.

The elasticity of the shield straps is preferably determined to make the shield move back up elastically towards the wearer's neck, once said wearer has stopped pulling on the pull-type handle, preferably until the shield is in contact with the wearer's neck, preferably until it rests on the wearer's neck.

In a third main embodiment, the invention proposes a backpack of the type described in the preamble which is noteworthy in that it comprises a belt referred to as a "shield belt" fixed to the compartment, preferably in a deactivatable manner, proximate to the base of the compartment, preferably at less than 30 cm, preferably at less than 20 cm, from said base, and adapted to be able to be fixed to the shield, at least temporarily, in the deployed position.

The shield belt therefore allows the shield to be immobilised against the wearer's torso.

Advantageously, this improves the protection of the wearer.

In a fourth main embodiment, the invention proposes a backpack of the type described in the preamble, noteworthy in that in the closed position the strap is fixed to the compartment by means of a magnetic fastening.

The use of a magnetic fastening advantageously allows detachment under the effect of a low amplitude force and, in particular, under the effect of the force exerted by the shield when the wearer pulls the pull-type handle. The implementation of a magnetic fastening makes the fastening deactivation devices useless, as links mechanically connecting the pull-type handle to the fastening to move said fastening towards its unfastened position at the same time as a the pull-type handle is pulled on to move the shield towards its deployed position, as described in FR 2 962 017.

This improves the discreetness of the backpack.

Magnetic fastenings likewise allow said fastening to be fastened and unfastened, while at the same time limiting wear.

In a fifth main embodiment, the invention proposes a backpack of the type described in the preamble in which, in the storage position, the shield is fixed, preferably suspended, in a deactivatable manner, to the compartment, preferably on the inside of the compartment, more preferably to the rear face of the compartment, in other words to the face which, when the backpack is worn by the wearer, extends at least in part against the back of said wearer.

In a sixth main embodiment, the invention proposes a backpack of the type described in the preamble, in which, when the shield is in the storage position and the flap is in the closed position, the pull-type handle extends over a height greater than 5 cm, preferably greater than 8 cm, above the top of the flap.

The backpack preferably comprises shoulder straps which are adapted in such a manner that when the backpack is worn by a wearer with the shield in the storage position the pull-type handle extends at least in part behind the nape of the neck, even behind the head of said wearer.

As will be seen in greater detail later on in the description, the presence of a pull-type handle of this kind allows the time required in order to deploy the shield to be considerably reduced and constitutes a particularly notable improvement.

In a seventh main embodiment, the invention proposes a backpack of the type described in the preamble in which the flap is detachable.

The flap preferably comprises an anti-trauma plate.

The flap may therefore advantageously act as a face guard, in particular.

The characteristics of the different embodiments may be combined.

A backpack according to the present invention may more particularly comprise one or a plurality of the following optional characteristics, whatever the main embodiment:

- the flap and/or the shield are adapted to ensure protection certified to NIJ-IIIA, NIJ-III or NIJ-IV, preferably NIJ-IV;
- the ballistic or "bullet-proof" protection material of the flap may be identical to or different from that used for the shield;
- in a preferred embodiment, the flap is integral with the compartment in the second open position;
- in the second open position, the flap preferably extends at least partially beneath the compartment, preferably in such a manner as to protect the lower part of the back, even the wearer's buttocks or legs;
- the elasticity of a shield strap preferably allows said shield strap to be lengthened (difference between the maximum length of the shield strap and the resting length of the shield strap) by more than 5%, by more than 10%, by more than 20%, by more than 30%, preferably by more than 50%, preferably by more than 60%, preferably by more than 70%, preferably by more than 75% of its initial length (before the tension is applied to lengthen it);
- the compartment, the shield and the shield straps are adapted so that tension on the shield straps enables them to create a neck which allows the head of the wearer and/or a motorcycle or combat helmet to pass through, a lengthening of the shield straps being preferably indispensable to this end;
- the elasticity of the shield straps is preferably such that tension on the shield straps allows a neck to be created, whereof the largest dimension and/or the equivalent diameter is greater than 20 cm, 25 cm, 30 cm, 40 cm, 50 cm;
- in one embodiment, the elasticity of the shield straps allows a neck to be created, the surface whereof is greater than 450 $cm^2$, preferably than 500 $cm^2$, preferably than 550 $cm^2$, than 600 $cm^2$, than 700 $cm^2$, even than 750 $cm^2$;
- the elasticity of the shield straps is such that, in the deployed position, the shield extends at less than 20 cm, preferably at less than 10 cm, preferably at less than 5 cm, from the neck of the wearer if the pull-type handle is not pulled on; the shield straps are fixed at less than 20 cm from the base of the compartment, preferably to the base of the compartment;
- in the idle position, the shield straps have a length greater than 35 cm, greater than 45 cm, greater than 50 cm, even greater than 60 cm;
- one, preferably each, shield strap takes the form of a flexible tubular casing, preferably made of fabric, preferably of polyester, containing an elastic cable;
- the compartment preferably has a capacity of less than 30 liters, preferably less than 25 liters, preferably less than 20 liters and/or more than 5 liters, preferably more than 10 liters, preferably more than 15 liters;
- the fixing of the shield to the compartment, in the storage position, is preferably configured in such a manner as to prevent the shield from resting on the base of the compartment in the storage position;
- the shield is suspended in such a manner that its upper edge extends at less than 10 cm from the upper edge defining the opening of the compartment;
- the backpack comprises a magnetic fastening capable of fixing the flap to the compartment in the closed position of the flap, deactivation of the magnetic fastening being necessary so that the flap moves from the closed position into the second open position;
- when the shield is in the storage position and the flap in the closed position, the pull-type handle extends to a height h of more than 8 cm, preferably more than 10 cm, preferably more than 12 cm, preferably more than 14 cm, above the top of the flap closing the opening of the compartment;
- the pull-type handle is in the shape of a closed loop;
- the pull-type handle is in the shape of a flexible tubular casing containing a stiffening flange;
- the pull-type handle is fixed to the shield at two fixing points spaced apart from one another by more than 10 cm, preferably more than 12 cm;
- the pull-type handle has a thickness of less than 10 mm;
- the pull-type handle is made up of a strip wound around itself in such a manner as to define a tube, said tube containing a stiffening flange;
- the pull-type handle is fixed to the shield in such a manner that, in the storage position in which the shield is preferably suspended in the compartment, the part of the pull-type handle disposed inside the compartment extends to a height of less than 10 cm, less than 5 cm, less 3 cm;
- the backpack comprises a first aid kit which is fixed, preferably in a removable manner, preferably by means of Velcro®-type self-fastening strips on the flap;
- the first aid kit is fixed in such a manner as to be accessible to the wearer when the flap is in the second open position, preferably in such a manner as to be accessible to the right hand and to the left hand of the wearer;
- the first aid kit contains at least one compressional dressing and/or an Israeli bandage;
- the flap is pierced by one or a plurality of vision holes;
- the flap comprises a flap handle, preferably two flap handles, preferably fixed to the inside face of the flap;
- the flap comprises an anti-trauma plate;
- the anti-trauma plate assembly of the flap extends over a surface representing more than 50%, preferably more than 60%, preferably more 70%, preferably more than 80%, preferably more than 90%, preferably more than 95%, preferably 100% of the inner surface of the flap.

DEFINITIONS

A fastening or fixing is referred to as being "deactivatable" when it can be selectively activated, in other words to ensure a fixing between two elements, or "deactivated" when it does not ensure this fixing.

The "equivalent" diameter of an opening or neck is the diameter of a disc with the same surface as said opening or neck.

Unless otherwise indicated, the terms used in the present application have the same meaning as the corresponding terms used in FR 2 962 017.

The descriptive terms defining relative positions, in particular "below", "front", "rear", "upper", "lower", "horizontal", "vertical" refer to a configuration in which the backpack is worn by a wearer standing vertically, the rear of the backpack denoting the side of the backpack toward the wearer, the flap being in the closed position. For example, the rear face of the compartment is the face exposed to the outside and the rear face of the compartment is the face which extends along the wearer's back. The rear face of the shield is the face exposed to the outside in the deployed position. The lower edge of the shield is the edge which extends proximate to the base of the compartment in the storage position and proximate to the carrier's neck in the deployed position.

"Comprising a", "consisting of a", "exhibiting a", should be understood to mean "comprising at least one" unless otherwise indicated.

BRIEF DESCRIPTION OF THE FIGURES

Other characteristics and advantages of the invention will again emerge on reading the detailed description which follows and on examining the attached drawing in which.

Figure 1:
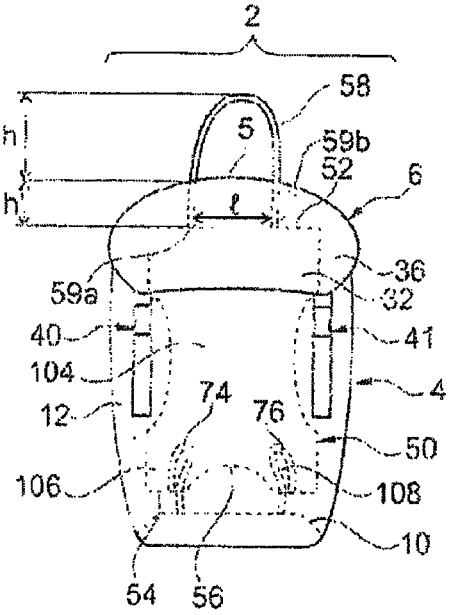
FIG. 1 depicts schematically the front face of a backpack according to the invention, with the flap in the closed position and the shield in the storage position, the shield being depicted using dotted lines in the compartment.
Figure 2:
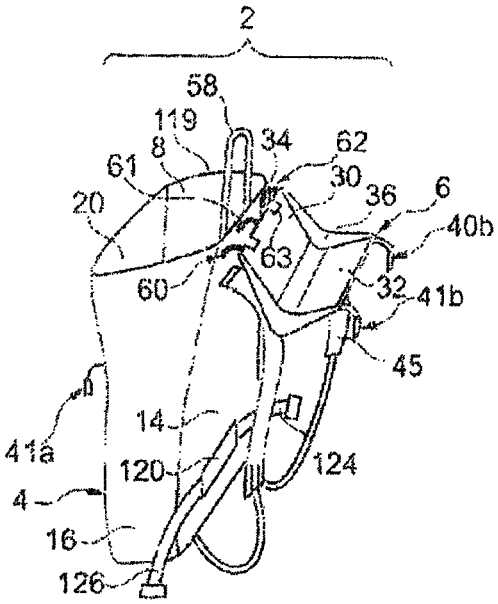
FIG. 2 depicts schematically, as a perspective view, the backpack in FIG. 1 with the flap in the first open position, the shield not having been depicted.

The reference numbers used in FR 2 962 017 have been reused wherever possible.

In the figures, identical reference numbers are used to denote identical or similar elements.

DETAILED DESCRIPTION

Backpack

From the outside, a backpack 2 according to the invention appears similar to conventional backpacks. All the features traditionally observed on a conventional backpack and, in particular, the presence of shoulder straps 45 and a lumbar belt may be applied to a backpack according to the present invention.

Strips are sewn to the shoulder straps 45, preferably substantially transversely in respect of the length of the shoulder straps, in order to constitute MOLLE-type hanging loops.

A backpack according to the invention comprises a compartment 4 closed by a flap 6.

The volume of the compartment is delimited by a horizontal base 10, a vertical front face 12, a vertical rear face 14 and two vertical side faces 16. The compartment preferably has a volume of less than 30 liters, less than 25 liters, preferably less than 20 liters, a volume of 18 liters being particularly suitable.

The length of the compartment is preferably greater than 40 cm, preferably greater than 45 cm, preferably greater than 50 cm, preferably greater than 55 cm.

Outer pockets may be disposed on the outside and/or on the inside of the compartment. A Velcro®-type fastening is preferably provided in the upper part of the compartment, so that a wire, for example a telephone wire, can be fixed there.

In its upper part, the compartment 4 defines a compartment opening 20 allowing a shield 50, as described above, to be inserted and removed.

The compartment preferably widens out progressively towards its opening 20, preferably from its base to its opening. This makes it easier for the shield to be removed.

The flap 6 preferably comprises a front edge 32, a rear edge 30 and lateral edges 36. The flap 6 is preferably made up, at least partly, of a bullet-proof material.

The material may, in particular, be one of the following types defined by the NIJ (United States National Institute of Justice) standard: I, IIA, II, IIIA, III, IV. The flap preferably comprises an insert in this kind of material, preferably in an NIJ-IIIA-type material, for example Dyneema®.

The material may conform to one or a plurality of standards issued by the Underwriters Laboratories (UL) and the United States National Institute of Justice and, in particular, UL Standard 752 and NIJ Standard 0101.04.

The flap 6 can be moved between a closed position in which it closes the opening 20 and first and second open positions described below, in which it leaves said opening open. In the closed position, the flap 6 is preferably fixed to the front face 12 of the compartment by deactivatable closures 40 and 41 and, to the rear face 14, by fastenings 60, 61 et 62 which are likewise deactivatable.

The closures 40 and 41 correspond to the closures traditionally used in conventional backpacks. The closures 40 and 41 may therefore be locked or unlocked in a reversible manner, in order to prevent or to allow access to the inside of the compartment. The fastenings 60 and 62 provided proximate to the upper edge of the rear face 14 act as a hinge when the closures 40 and 41 are unlocked, in order to swing the flap 6 towards the back of the compartment, in order to move it towards its first conventional, open position.

The fastenings 60, 61 and 62 are likewise deactivatable, preferably in a reversible manner, in other words they can be configured in unfastened and fastened positions in which they no longer link and link, respectively, the rear edge 34 of the flap to the rear face 14 of the compartment 4. In the figures, letters "a" and "b" denote the parts of fastenings or closures which are fixed to the compartment and to the flap, respectively.

The movement from the fastened position to the unfastened position may result from the deployment of the shield 50 between a storage position in which said shield is housed in the compartment and a deployed position in which the shield 50 extends in front of the wearer in such a manner as to protect him.

Closures 40 and 41 are preferably fixed to the compartment 4 by means of flap straps 100 and 101, respectively. The closures 40 and 41 and the flap straps 100 and 101 act as hinges when the fastenings 60 and 62 are unfastened and the flap is swung over towards the front of the compartment 4, in other words towards the second open position.

The length of the flap straps is preferably adjusted in such a manner that in the second open position, in other words after the flap 6 has been swung over following an unfastening of the fastenings 60 and 62, the flap 6 extends, preferably partially, below the compartment 4.

In the second open position, the flap preferably extends over a distance d of more than 10 cm, more than 20 cm, more than 30 cm, below the base 10 of the compartment 4. The flap 6 preferably extends in such a manner as to protect the top of the buttocks, particularly the kidneys, arteries and iliac veins.

The width d' of the flap is preferably greater than 20 cm, preferably greater than 25 cm, preferably greater than 30 cm.

In a preferred embodiment, the fastenings 60, 61 and 62 are magnetic fastenings.

In a preferred embodiment, the flap is detachable from the rest of the backpack. The wearer may therefore use it as a guard, particularly for protecting the face.

To allow the flap to be detached, each flap strap 100 and 101 may, for example, be made up of two parts fixed to the compartment and to the flap, respectively, and fastened to one another by means of Velcro®-type self-fastening strips. Alternatively, the closures 40 and 41 may be deactivatable by simply pulling on the flap. For example, they may be magnetic.

The flap dimensions are preferably calculated to allow a face to be covered. The flap preferably exhibits a general bowl shape, in such a manner that the head is able to engage with it up to a facial protection position. The flap 6 then advantageously allows the sides of the head to be likewise protected.

In one embodiment, the flap 6 is pierced with one or a plurality of vision holes 102, allowing the wearer to see in front of him in the facial protection position. Each vision hole preferably exhibits a surface of less than 5 $cm^2$, preferably less than 3 $cm^2$, preferably less than 2 $cm^2$, preferably less than 1 $cm^2$, preferably less than 0.5 $cm^2$, preferably less than 0.25 $cm^2$ and/or preferably greater than 0.01 $cm^2$, preferably greater than 0.05 $cm^2$, preferably greater than 0.1 $cm^2$, preferably greater than 0.2 $cm^2$. Discreetness and security are improved by this.

Figure 3:
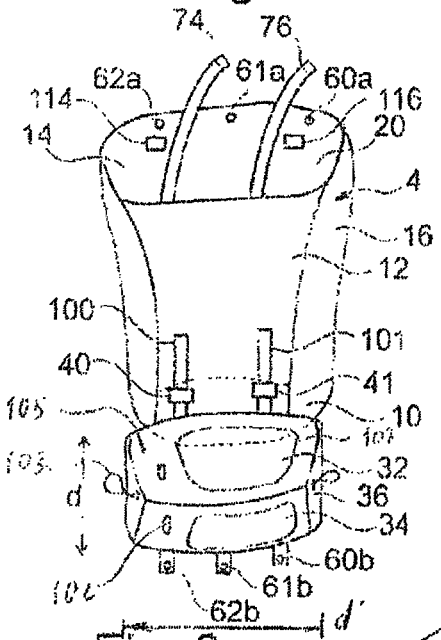
FIG. 3 depicts schematically the backpack in FIG. 1 with the flap in the second open position, the shield not having been depicted.
Figure 4:
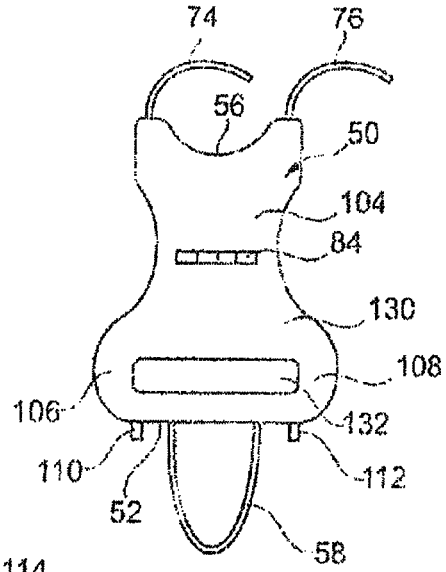
FIG. 4 depicts schematically the shield of the backpack shown in FIG. 1 in the deployed position.

When it is observed from the front, as shown in FIG. 3, the flap exhibits a surface area of more than 1600 $cm^2$, preferably more than 1800 $cm^2$, preferably more than 2000 $cm^2$, preferably more than 2200 $cm^2$, preferably more than 2500 $cm^2$.

More preferably, the flap comprises a flap handle 103 allowing the flap to be gripped. The flap handle 103 is preferably fixed in such a manner that the wearer is able to keep the flap 6 in front of his face without exposing the hand holding onto the flap handle.

The flap handle is preferably fixed to the inner face 105 of the flap, in other words to the face of the flap which is exposed towards the compartment in the closed position depicted in FIG. 1.

More preferably, the flap comprises at least right and left flap handles fixed to the flap sides, preferably to the lateral edges 36 of the flap, preferably to the inner face 105 of the flap. The wearer is preferably able to pull on the right and left flap handles with his right and left hands, respectively, in order to put the flap against the facial protection position. The vision holes 102 are then preferably substantially opposite the eyes of the wearer.

The flap handle or handles are preferably made of fabric. They may, in particular, take the shape of a cord or ribbon loop.

More preferably, the flap comprises an anti-trauma plate 107, made of Kevlar for example, preferably ceramic. An anti-trauma plate, known per se, exhibits a high degree of rigidity which advantageously limits trauma to the body resulting from an impact from a high-calibre bullet. An anti-trauma plate is preferably inserted in the front edge 32 and the rear edge 30, as shown in FIG. 3, and, again preferably, in the lateral edges 36.

Preferably more than 50%, preferably more than 60%, preferably more than 70%, preferably more than 80%, preferably more than 90%, preferably more than 95%, preferably 100% of the flap surface is protected by at least one anti-trauma plate.

The bullet-proof shield 50 preferably comprises a main body 104 and a right wing 106 and a left wing 108 which protect the sides of the wearer in the deployed position.

The right and left wings can fold back against the main body of the shield in the storage position. Preferably, however, they are fixed to the main body in such a manner that they tend to move away elastically from said main body. Hence, they advantageously allow the front and rear faces of the compartment to be kept spaced apart and therefore to simulate a filling of the compartment. Moreover, in the deployed position, this spacing apart increases the speed with which said wings are positioned against the sides of the wearer and therefore improves their protection. In the storage position, the pressure exerted by the shield preferably determines the outer shape of the compartment.

The shield 50 preferably exhibits an upper edge 52 and a lower edge 54 extending substantially horizontally. The lower edge 54 preferably contains an indentation 56 allowing the wearer's head to pass through. The upper edge 52 exhibits a pull-type handle 58 which extends to the outside of the compartment in the storage position, crossing a passage between the flap and the edge of the opening 20. This passage may, in particular, take the shape of one or a plurality of slots.

The length of the shield, in other words the greatest distance between the upper edge 52 and the lower edge 54, is preferably greater than 40 cm, preferably greater than 50 cm, preferably greater than 60 cm, even greater than 70 cm. Advantageously, the wearer does not need to wear the shield in the deployed position permanently. Unlike a conventional bullet-proof vest, the shield may therefore be longer in length, thereby ensuring maximum protection without getting in the way of the wearer, particularly when he is seated.

The shape of the pull-type handle is not limiting. The pull-type handle 58 is preferably bow-shaped, the two ends 59*a* and 59*b* being fixed to the upper edge 52 of the shield. The bow shape, in other words a closed loop shape, of the pull-type handle allows it to be hooked by the wearer. In particular, the pull-type handle may be caught hold of by a single finger, without there being any risk of the pull-type handle sliding and slipping away.

The fixing points of said ends 59*a* and 59*b* to the shield are preferably spaced apart at a distance l greater than 8 cm, preferably greater than 10 cm, preferably greater than 12 cm, preferably greater than 14 cm, than 18 cm, than 20 cm, than 25 cm, than 30 cm.

When the shield is in the storage position, as shown in FIG. 1, the backpack being disposed vertically, the pull-type handle upwards, the pull-type handle preferably projects beyond the compartment by a height greater than 5 cm, 10 cm, 15 cm, 20 cm, 25 cm and, preferably, projects beyond the top S of the flap, in the closed position, by a height greater than 5 cm, 8 cm, 10 cm, 15 cm, 20 cm, 25 cm.

Preferably, as shown in FIG. 1, the pull-type handle extends in the storage position below the top S of the flap, preferably on the inside of the compartment (in other words, below the upper edge 119 of the opening of the compartment), to a height h' of less than 10 cm, preferably less than 7 cm, preferably less than 5 cm and/or more than 2 cm, more than 3 cm.

More preferably, the pull-type handle is self-supporting, in other words, in the storage position, in the absence of any contact other than with the compartment, the flap and the shield, the pull-type handle is kept in a substantially vertical plane, as shown in FIG. 1.

The inventors have performed numerous tests and have discovered that these characteristics assist with gripping considerably and allow the shield to be deployed more quickly. Moreover, they allow the wearer to catch hold of the pull-type handle with the right hand or the left hand, which is particularly advantageous when the wearer is injured.

In order to make deployment still easier, the shoulder straps 45 are preferably adjusted in such a manner that the upper part of the handle 58 is disposed at neck height, preferably at the height of the nape of the neck.

The pull-type handle 58 is preferably made from a strip, preferably of fabric, wound around itself widthways in such a manner as to constitute a hollow tube. The width of the strip before it is wound around may be greater than 10 mm, than 15 mm, than 20 mm and/or less than 35 mm, than 30 mm. The strip may, in particular, be made of polyester.

The pull-type handle preferably exhibits a resistance greater than 1300 daN, than 1500 daN, than 1700 daN, than 1800 daN.

The length of the pull-type handle is preferably greater than 20 cm, than 25 cm, than 30 cm and/or less than 45 cm, than 40 cm, a length of 35 cm being ideally suited.

In order to stiffen the pull-type handle, the strip forming the tube preferably contains a stiffening flange, preferably made of metal or polymer. In one embodiment, three steel strands 3 mm in diameter or a flange with a 10.7 mm diameter made of woven polyamide may be introduced into the lumen of the tube. The length of the flange introduced into the tube is preferably greater than 25 cm and/or smaller than 30 cm, preferably smaller than the length of the tube.

The pull-type handle preferably has a thickness e of less than 10 mm, preferably less than 8 mm, which allows it to be hooked using the hand or using a finger. The thickness of the pull-type handle is the smallest dimension in a transverse cross section of said pull-type handle. The thickness e is preferably less than 10 mm, preferably less than 8 mm, whatever the cross section of the pull-type handle under consideration.

At least one fastening 60-62 is preferably disposed on either side of the pull-type handle and, in the event that the pull-type handle is in the shape of a bow, at least one fastening is disposed between the two fixing points of the pull-type handle on the flap.

The rear side 30 of the flap has a rear edge 34 preferably including notches 63 disposed to allow the pull-type handle of the shield to pass through when the flap is in the closed position. The existence of notches 63 prevents the rear edge 34 from tilting the pull-type handle and thereby allows said pull-type handle to be kept in a substantially vertical position.

In the storage position, the shield preferably extends against the rear face 14 of the compartment. The shield is preferably immobilised in the compartment in such a manner that it does not rest on the base 10 of the compartment. The shield is not therefore deformed, which preserves its protective capacity in the deployed position.

More preferably, in the storage position the shield is in contact with the compartment. In particular, it is preferably not housed in a casing.

In the storage position, the shield is preferably suspended in the compartment.

To this end, the shield preferably comprises a tongue preferably projecting from the side 52 of the shield and capable of being introduced into a corresponding housing formed on the compartment, for example by means of a strap, two opposite, preferably substantially vertical, sides of which are sewn to the compartment.

The suspension device is preferably of the MOLLE or "modular light weight load carrying equipment" type.

Figure 5:
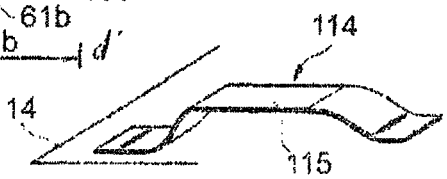
FIG. 5 depicts schematically a detail of the backpack in FIG. 3.

In a preferred embodiment, the shield comprises two tongues 110 and 112, or "feet", projecting from the upper edge 52 of the shield and being housed in the storage position in respective housings 114 and 118, preferably formed by one or a plurality of straps 115 sewn to the rear face 14 of the compartment, as shown in FIG. 5.

At least the part of the tongue which is introduced into an housing is preferably stiffened, for example by means of an insert or by superposing a plurality of pieces of straps. The rigidity of a tongue preferably makes it self-supporting. It preferably allows it to remain planar, even when it is held by its end fixed to the shield, vertically and horizontally. Advantageously, this facilitates its insertion into the corresponding housing but likewise its removal from said housing. A tongue preferably exhibits a length greater than 2 cm, greater than 3 cm, greater than 4 cm and/or less than 7 cm, less than 6 cm.

The tongues advantageously enable a precise positioning of the shield in the compartment to be guaranteed. This positioning is determined in order to allow the shield to be removed.

The suspension tongues are preferably disposed on either side of the pull-type handle 58. The shield preferably complies with at least one of the standards referred to in US 2009/014490.

More preferably, the shield is suspended in the storage position in such a manner that its upper edge 52 extends at less than 10 cm, at less than 7 cm, at less than 5 cm, at less than 4 cm from the upper edge 119 defining the opening 20 of the compartment. This speeds up deployment of the shield. Moreover, the pull-type handle remains permanently accessible.

More preferably, the shield is suspended in the storage position in such a manner that its upper edge 52 extends by more than 1 cm, more than 2 cm, more than 3 cm from the upper edge 119 defining the opening 20 of the compartment. The pull-type handle may thereby be supported on the compartment, which improves its maintenance in the vertical position.

The lower edge 54 of the shield is linked to the compartment 4, preferably to the rear face of the compartment 4, by means of two shield straps 74 and 76 disposed in such a manner that they each rest on one of the wearer's shoulders in the deployed position. Each shield strap therefore comprises one end fixed to the shield, preferably to the lower edge 54 of the shield, and one end fixed on the inside of the compartment 4, preferably to the rear face of said compartment, preferably at less than 20 cm, preferably at less than 10 cm, from the base 10 of the compartment.

The length of the shield straps is preferably adjustable, in order to be adapted to the shape of the wearer.

The shield straps are preferably elastic, so that they can be lengthened when the wearer pulls on the pull-type handle 58. Their fixing proximate to the base 10 of the compartment advantageously allows their lengthening capacity to be maximised.

In a preferred embodiment, the shield straps take the shape of a tubular casing, either elastic or non-elastic, preferably non-elastic, made of polyester for example, and contain an elastic cable, preferably two cables, preferably three elastic cables. The resistance of the tubular strap is preferably greater than 1000 daN, than 1100 daN, than 1200 daN.

The length of the tubular strap is preferably substantially equal to the length of the elastic cable after it has been lengthened. In the idle position, the tubular strap is preferably folded, such that it can be lengthened, even if it is not elastic or is less elastic than the flange or the elastic cables.

For optimum resistance, each elastic cable is preferably made up of a plurality of strands, preferably made of rubber or elastomer, preferably covered with a textile sheath.

Of course, a shield strap may only be elastic over a fraction of its length.

More preferably, each shield strap comprises a fitting which allows it to be detached from the shield and/or the compartment.

The backpack preferably comprises a sleeve 120 in which a shield belt 122 can be housed, at least one free end of the shield belt projecting beyond the sleeve. By pulling this free end, the wearer can, following deployment of the shield, draw close to said free end of the shield, then fix it, preferably in a deactivatable manner, to said shield. The fixing may, in particular, be guaranteed by Velcro®-type self-fastening strips.

The shield belt preferably comprises right 124 and left 126 free ends projecting to the right and left of the wearer and which the wearer can pull until he can fix them to the shield in the deployed position.

A portion, preferably a substantially central portion, of the shield belt is fixed to the compartment, preferably inside of the sleeve, for example by means of Velcro®-type self-fastening strips.

In one embodiment, the sleeve comprises right and left openings from which the right free end 124 and the left free end 126, respectively, project from the shield belt. More preferably, the sleeve is in the shape of a strip, one edge whereof, preferably an upper edge, is fixed to the compartment and one edge, preferably a lower edge opposite said upper edge, is temporarily fixed to the compartment, for example by means of Velcro®-type self-fastening strips. By pulling the upper edge, the wearer is therefore able to access the part of the shield belt disposed in the sleeve. This access in particular allows the shield belt to be stored inside the sleeve.

More preferably, the shield belt is fixed in a deactivatable manner, for example by means of Velcro®-type self-fastening strips, such that when the backpack is in use with the shield in the storage position, the shield belt cannot emerge from said sleeve. Hence, the length of the free ends of the shield belt which project beyond the sleeve remain constant provided the wearer does not pull up.

The free right end 124 and/or the free left end 126 of the shield belt is/are preferably provided with fastenings 128, for example with clip fastenings. These fastenings may advantageously constitute decoys, making it appear that the shield belt is a lumbar belt of the kind traditionally used for backpacks. These fastenings, which are preferably mock, allow two free ends of the shield belt to be removed from the sleeve and said free ends to be fixed to the shield in the deployed position. The front face 130 of the shield, in other words the face that is exposed towards the outside in the deployed position, preferably comprises Velcro®-type self-fastening strips 132 which are capable of cooperating with corresponding strips fixed to the free ends of the shield belt, in order to keep the shield in the deployed position. The shield belt may therefore be advantageously deployed and fixed to the shield very quickly.

In one embodiment, the fastenings of the shield belt are not mock and can be fixed one to the other. The wearer may therefore use the shield belt as a conventional lumbar belt when the shield is in the storage position. However the shield belt comprises means for fixing the shield in the deployed position, for example a Velcro®-type self-fastening strip.

In a preferred embodiment, the shield belt comprises two self-fastening strips, preferably Velcro®-type, on each of its two faces, respectively, disposed in such a manner as to be able to hook corresponding strips disposed on each of the two large faces of the shield, respectively. The shield may therefore be advantageously connected and fixed to the shield belt when the wearer is already using the shield belt (the face of the main part of the shield which covers the wearer's torso is fixed to the face exposed to the outside of the shield belt) or the free ends of the shield belt may be connected to the shield which is already in the deployed position (the inner face of each free end of the shield belt is fixed to the face exposed to the outside of the main part of the shield).

The front face of the shield preferably comprises MOLLE-type strips 84 for fixing tools, traditionally used for military equipment. In particular, the strips 84 may receive a firearm case.

A carrying handle is preferably fixed to the compartment, in order to allow the backpack to be carried by hand, particularly with the shield in the storage position.

In a preferred embodiment, the carrying handle is fixed in such a manner as to resist snatching at a force of 800 N, preferably of 1000 N, preferably of 1200 N, preferably of 1500 N, preferably of 2000 N. The carrying handle may therefore advantageously act as a removal handle so that, where appropriate, a person can draw on the wearer when he can no longer move without assistance, in the event of injury for example.

The carrying handle can preferably be immobilised in a deactivatable manner on the compartment, for example by means of a Velcro®-type self-fastening system. Advantageously, there is therefore no risk of the wearer confusing the carrying handle for the pull-type handle when wearing the backpack.

The backpack preferably looks like a city bag and does not comprise a lumbar belt other than, optionally, the shield belt.

Operation

In the initial position, the backpack is worn by the wearer in the conventional manner with the shoulder straps resting on the wearer's shoulders and the optional lumbar belt being fixed in such a manner as to wrap around the wearer, traditionally substantially level with the navel or the sternum. The shield is in the storage position at this point, the flap 6 being in the closed position, closing the opening 20 of the compartment 4. The tongues of the shield are housed in the corresponding housings in the rear face 14 of the compartment, which prevents the shield from becoming deformed by resting on the base of the compartment and allows the shield to be positioned in such a manner as to allow it to be removed from the compartment. The pull-type handle projects from the compartment 4, emerging from said compartment between the rear edge 34 of the flap and the edge of the compartment delimiting the opening 20. The pull-type handle thereby extends behind the head of the wearer. The fastenings 60 and 62 are in the fastened position and the closures 40 and 42 are in the closed position. The carrying handle is kept against the compartment 4, preferably in such a manner that only the pull-type handle can be accessed by the wearer. The shield belt is stored in its housing, except for its two free ends which extend further, on the right and on the left, respectively, such that they can easily be grabbed by the wearer.

In the initial position, the small-sized backpack is perfectly discreet and resembles a city backpack, the pull-type handle easily being mistaken for the carrying handles traditionally fitted to this type of backpack.

In order to deploy the shield, the wearer grips the pull-type handle 58 and pulls it upwards. This pulling action, through the action of the shield, causes the fastenings 60 and 62 to unfasten. Because the fastenings are magnetic, pulling with only one hand is sufficient to unfasten them. With the fastenings 60 and 62 in the unfastened position, the flap 6 swings into the second open position under the effect of the shield emerging from the compartment. Under the effect of gravity, the flap falls until it is held in a suspended position by the flap straps and the closures 40 and 42 (second open position). Because the flap is reinforced, it can then protect the lower back, including the wearer's buttocks.

A second bulletproof shield, preferably made of a material identical to that of the shield 50, is preferably fixed to the front face or the rear face, preferably to the rear face of the backpack. The second shield is preferably formed to guarantee protection certified to NIJ-IIIA, NIJ-III or NIJ-IV, preferably at least to NIJ-III.

The flap allows the protection guaranteed by this second bulletproof shield to be extended to protect the wearer's back in the deployed position.

After the pulling action, the shield straps which hold the shield on the compartment stretch. Their elasticity then allows them to lengthen and thereby increase the gap between the shield and the opening of the compartment. This makes it easy for the wearer to pass the shield over his head and to lower it onto his torso, even if he is wearing a combat helmet or a motorcycle helmet.

After passing it over his head, the wearer lowers the shield so that it rests on his stomach. The wings of the shield are then able to protect the wearer's sides.

The elasticity of the shield straps is preferably determined so that the shield immediately lifts towards the wearer's neck once the wearer has stopped pulling on the pull-type handle. The wearer thereby benefits from immediate protection of the upper part of his torso, a region that it is particularly crucial to protect.

The provision of the pull-type handle above the backpack allows it to be grasped very easily and, in conjunction with the elasticity of the straps, allows particularly quick deployment. Tests have shown that deployment is possible within less than 2 seconds, which, to the inventors' knowledge, constitutes unparalleled performance.

Moreover, the configuration of the pull-type handle allows the wearer to keep the shield on his stomach easily, which is particularly useful if the wearer has to move, for example run, before having been able to fix the shield belt to the shield. The rigidity of the pull-type handle is preferably determined so that the shield does not move laterally when the wearer runs while holding said pull-type handle.

Next, the wearer grabs the free ends of the shield belt.

The wearer then pulls on the two free ends of the shield belt, which allows the length of the sections of the shield belt projecting beyond the sleeve to be increased. The wearer can then lower these sections of the shield belt to the shield. The Velcro®-type self-fastening strips fixed to said free ends and to the shield may then cooperate in order to keep the shield effectively against the torso and stomach of the wearer. The wearer is then optimally protected, without the shield inhibiting his movements. Moreover, tests have shown that deployment of the shield belt is possible in less than 2 seconds.

The front face of the shield preferably comprises a sleeve for a firearm. This means that the wearer can advantageously access his firearm as soon as the shield is deployed.

Where required, for example after taking cover, the wearer may detach the flap and use it as a guard, particularly in order to protect his face. However the vision holes will allow him to continue observing his environment.

As is clear in the present case, a backpack according to the invention is very discreet when the shield is in the storage position, can be deployed extremely quickly, then guarantee effective protection with a high degree of comfort, particularly in a region of the back which is not covered by the compartment of the backpack. The invention is not of course limited to the embodiments described and represented, these being provided for descriptive purposes and not intended to be limiting in nature. In particular, the number and shape of the fastenings, closures or pull and carrying handles are not limiting. For example, the fastenings could be realised with the help of Velcro®-type self-fastening strips or with snap fasteners. The backpack may likewise not comprise fastenings or closures. The fastenings may likewise attach the shield and the flap and not the flap and the compartment.

The closures 40 and 41 which are used to suspend the flap in the second open position, could likewise be replaced or supplemented by any other suspension element, for example by a strap attaching the flap and the compartment.

The invention claimed is:

1. A backpack comprising:

a compartment exhibiting a compartment opening;

a flap that can be moved between a closed position in which it closes the compartment opening and first and second open positions in which it leaves the compartment opening open after swinging over from the closed position towards the back and front of the compartment, respectively;

a ballistic protection shield that can be moved, passing through the compartment opening and over the head of a backpack wearer, from a storage position in which it is accommodated in the inside of the compartment to a deployed position in which it protects the torso of the backpack wearer; and shield straps linking the shield to the compartment capable of suspending the shield in the deployed position, the backpack defining a passage between the edge of the compartment opening and the flap in the closed position and comprising a pull-type handle fixed to the shield and projecting to the outside of the compartment by way of this passage when the shield is in the storage position and when the flap is in the closed position, wherein the flap is made at least in part of a ballistic protection material.

2. The backpack according to claim 1, having a configuration such that in the second open position the flap extends at least partially beneath the compartment in such a manner as to protect the lower part of the wearer's back.

3. The backpack according to claim 1, wherein in the second open position the flap extends over a distance of more than 10 cm below the base of the compartment.

4. The backpack according to claim 3, wherein in the second open position the flap extends over a distance of more than 30 cm below the base of the compartment.

5. The backpack according to claim 1, wherein the flap and/or the shield are configured to ensure protection certified to NIJ-III, NIJ-IIIA or NIJ-IV.

6. The backpack according to claim 1, wherein the shield straps exhibit a degree of elasticity allowing said shield straps to be lengthened by more than 5% of their original length.

7. The backpack according to claim 6, wherein the elasticity of any shield strap allows a lengthening of said shield strap by more than 20% of its initial length.

8. The backpack according to claim 7, wherein the elasticity of any shield strap allows a lengthening of said shield strap by more than 50% of its initial length.

9. The backpack according to claim 6, wherein the elasticity of the shield straps is such that tension on the shield straps allows the creation of an opening which allows the wearer's head to pass through, whereof the largest dimension and/or the equivalent diameter is greater than 25 cm.

10. The backpack according to claim 9, wherein the elasticity of the shield straps is such that tension on the shield straps allows the creation of an opening which allows the wearer's head to pass through, whereof the largest dimension and/or the equivalent diameter is greater than 30 cm.

11. The backpack according to claim 6, wherein each shield strap takes the form of a flexible tubular casing containing an elastic cable.

12. The backpack according to claim 6, wherein the elasticity of the shield straps is determined so that in the deployed position the shield moves back up towards the wearer's neck immediately, once said wearer has stopped pulling on the pull-type handle.

13. The backpack according to claim 12, wherein in the deployed position the shield extends at less than 20 cm from the neck of the wearer if the pull-type handle is not pulled on.

14. The backpack according to claim 13, wherein, in the deployed position, the shield extends at less than 5 cm from the neck of the wearer if the pull-type handle is not pulled on.

15. The backpack according to claim 6, wherein the compartment, the shield and the shield straps are configured so that tension on the shield straps enables them to create a neck which allows the head of the wearer and/or a motorcycle helmet and/or a combat helmet to pass through.

16. The backpack according to claim 1, wherein, in the storage position, the shield is fixed in a deactivatable manner to the compartment.

17. The backpack according to claim 1, wherein the shield straps are fixed less than 20 cm from the base of the compartment.

18. The backpack according to claim 1, comprising a first aid kit fixed in a removable manner to the flap.

19. The backpack according to claim 1, wherein the compartment has a capacity of less than 20 liters.

20. The backpack according to claim 1, wherein when the shield is in the storage position and the flap is in the closed position, the pull-type handle extends to a height of more than 5 cm above the top of the flap.

21. The backpack according to claim 20, wherein said height is greater than 8 cm.

22. The backpack according to claim 20, wherein the pull-type handle is fixed to the shield at two fixing points spaced apart from one another by more than 10 cm.

23. The backpack according to claim 1, comprising shoulder straps configured such that when the backpack is worn by a wearer with the shield in the storage position, the pull-type handle extends at least in part behind the nape of the neck of said wearer.

24. The backpack according to claim 1, wherein, in the storage position, the shield is suspended in such a manner that its upper edge extends at less than 10 cm from the upper edge defining the opening of the compartment.

25. The backpack according to claim 1, wherein the smallest dimension of the pull-type handle in any transverse cross section is less than 10 mm.

26. The backpack according to claim 1, wherein the pull-type handle is in the shape of a closed loop.

27. The backpack according to claim 1, wherein the pull-type handle is in the shape of a flexible tubular casing containing a stiffening flange.

28. The backpack according to claim 1, wherein in the closed position the flap is fixed to the compartment by at least one magnetic fastening and/or by one self-fastening strip and/or with one snap fastener.

29. The backpack according to claim 1, wherein the flap is detachable.

30. The backpack according to claim 1, wherein the flap is pierced by one or a plurality of vision holes.

31. The backpack according to claim 1, wherein the flap comprises a flap handle.

32. The backpack according to claim 1, wherein the flap comprises an anti-trauma plate.

33. The backpack according to claim 32, wherein the anti-trauma plate assembly of the flap extends over a surface representing more than 50% of the inner surface of the flap.

34. The backpack according to claim 33, wherein the anti-trauma plate assembly of the flap extends over a surface representing more than 80% of the inner surface of the flap.

35. The backpack according to claim 1, comprising a sleeve in which a shield belt, fixed to the compartment, is housed, each free end of the shield belt projecting beyond the sleeve, and being provided with fixing means, such that by pulling on said free end, the wearer can, following deployment of the shield, draw said free end close to the shield, then fix it to said shield.

36. The backpack according to claim 35, wherein the fixing means comprise a self-fastening strip capable of cooperating with a self-fastening strip on the shield.

* * * * *